US007236045B2

(12) United States Patent
Tschanz et al.

(10) Patent No.: US 7,236,045 B2
(45) Date of Patent: Jun. 26, 2007

(54) BIAS GENERATOR FOR BODY BIAS

(75) Inventors: James W. Tschanz, Portland, OR (US); Stephen H. Tang, Pleasanton, CA (US); Victor Zia, Beaverton, OR (US); Badarinath Kommandur, Hillsboro, OR (US); Siva G. Narendra, Portland, OR (US); Vivek K. De, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 159 days.

(21) Appl. No.: 11/038,394

(22) Filed: Jan. 21, 2005

(65) Prior Publication Data

US 2006/0164152 A1 Jul. 27, 2006

(51) Int. Cl.
*G05F 1/10* (2006.01)

(52) U.S. Cl. ..... 327/534; 327/537

(58) Field of Classification Search ..... 327/530, 327/534–537, 538, 539, 540, 541, 542, 543
See application file for complete search history.

(56) References Cited

U.S. PATENT DOCUMENTS 5,397,934 A * 3/1995 Merrill et al. ..... 327/537
6,097,113 A * 8/2000 Teraoka et al. ..... 307/125
6,366,156 B1 * 4/2002 Narendra et al. ..... 327/534
6,429,726 B1 * 8/2002 Bruneau et al. ..... 327/537
6,448,840 B2 * 9/2002 Kao et al. ..... 327/534
6,469,572 B1 * 10/2002 Bruneau et al. ..... 327/537
6,518,817 B2 * 2/2003 Anderson et al. ..... 327/537
6,885,234 B2 * 4/2005 Ando ..... 327/534
6,933,744 B2 * 8/2005 Das et al. ..... 326/17
7,015,764 B2 * 3/2006 Starr et al. ..... 331/78

OTHER PUBLICATIONS

James W. Tschanz et al. "Adaptive Body Bias for Reducing Impacts of Die-to-Die and Within-Die Parameter Variations on Microprocessor Frequency and Leakage;" IEEE Journal of Solid-State Circuits, vol. 37, No. 11, Nov. 2002; pp. 1396-1402.
Stefanos Sidiropoulos et al., "A Semidigital Dual Delay-Locked Loop;" IEEE Journal of Solid-State Circuits, vol. 32, No. 11, Nov. 1997; pp. 1683-1692.
John G. Maneatis; Low-Jitter Process-Independent DLL and PLL Based on Self-Biased Techniques; IEEE Journal of Solid-State Circuits, vol. 31, No. 11, Nov. 1996; pp. 1723-1732.
David J. Foley et al., "A 3.3V, 1.6GHz, Low-Jitter, Self-Correcting DLL Based Clock Synthesizer in 0.5 μm CMOS;" IEEE International Symposium on Circuits and Systems, May 28-31, 2000, Geneva, Switzerland, pp. II-249-II-252.

* cited by examiner

*Primary Examiner*—Timothy P. Callahan
*Assistant Examiner*—Hai L. Nguyen
(74) *Attorney, Agent, or Firm*—Fleshner & Kim, LLP

(57) ABSTRACT

A bias generator is provided that includes a central bias generator to provide a first bias voltage and a local bias generator to receive the first bias voltage and to provide a second bias voltage. The central bias generator may include a replica bias generator circuit substantially corresponding to the local bias generator.

22 Claims, 8 Drawing Sheets

BIAS GENERATOR FOR BODY BIAS

FIELD

Embodiments of the present invention may relate to signal generators. More particularly, embodiments of the present invention may relate to the generation of forward body bias signals for driving circuits.

BACKGROUND

Adaptive body bias may be used after fabrication to improve a bin split in microprocessors and to reduce a variation in frequency and leakage caused by process variations. In performing adaptive body bias, a unique body bias voltage may be set to maximize the frequency of the processor subject to leakage and total power constraints and the type of transistor technology in use. Body bias voltages may be applied to processors and other circuits that use PMOS transistors, NMOS transistors, or both.

Two types of body bias voltages may be used to control the frequency of a microprocessor, namely forward body bias (FBB) voltage and reverse body bias (RBB) voltage. If forward body bias (FBB) is used, the frequency of the processor may increase along with leakage. If reverse body bias (RBB) is applied, the frequency and leakage of the processor may decrease. In some circuits, both forward and reverse body bias voltages are applied in order to compensate for process variations within the die. Parts of the circuit that are too slow may receive forward body bias to increase their speed, while other parts that are faster than necessary may receive reverse body bias to reduce their leakage power. Because the effectiveness of RBB is diminishing with process scaling and because leaky dies may be recovered better by lowering the Vcc, an adaptive body bias technique that uses FBB may be attractive.

The circuitry for applying adaptive body bias may include two blocks, namely a central bias generator (CBG) and a local bias generator (LBG). The central bias generator may generate a reference voltage that is process, voltage and temperature independent. This voltage may represent the desired body bias to apply to transistors in the microprocessor core or other locations. If both PMOS and NMOS transistors are to be biased, then two central bias generators may be used each generating a different reference voltage for each transistor type. Alternatively, a single central bias generator may be used that is capable of generating the reference voltages for both transistor types.

On the other hand, many local bias generators may be distributed throughout a processor die. The local bias generators may translate the reference voltage from the CBG into local block supply voltages and then drive these voltages to the transistors or other devices in each respective block. The translation may ensure that if a local block supply voltage changes, the body bias will change at substantially a same time so that a constant bias is maintained. For example, for NMOS body bias, the body voltage may track any variation in the local block ground (Vss).

BRIEF DESCRIPTION OF THE DRAWINGS

The foregoing and a better understanding of embodiments of the present invention may become apparent from the following detailed description of arrangements and example embodiments and the claims when read in connection with the accompanying drawings, all forming a part of the disclosure of this invention. While the foregoing and following written and illustrated disclosure focuses on disclosing arrangements and example embodiments of the invention, it should be clearly understood that the same is by way of illustration and example only and the invention is not limited thereto.

The following represents brief descriptions of the drawings in which like reference numerals represent like elements and wherein.

DETAILED DESCRIPTION

Figure 1:
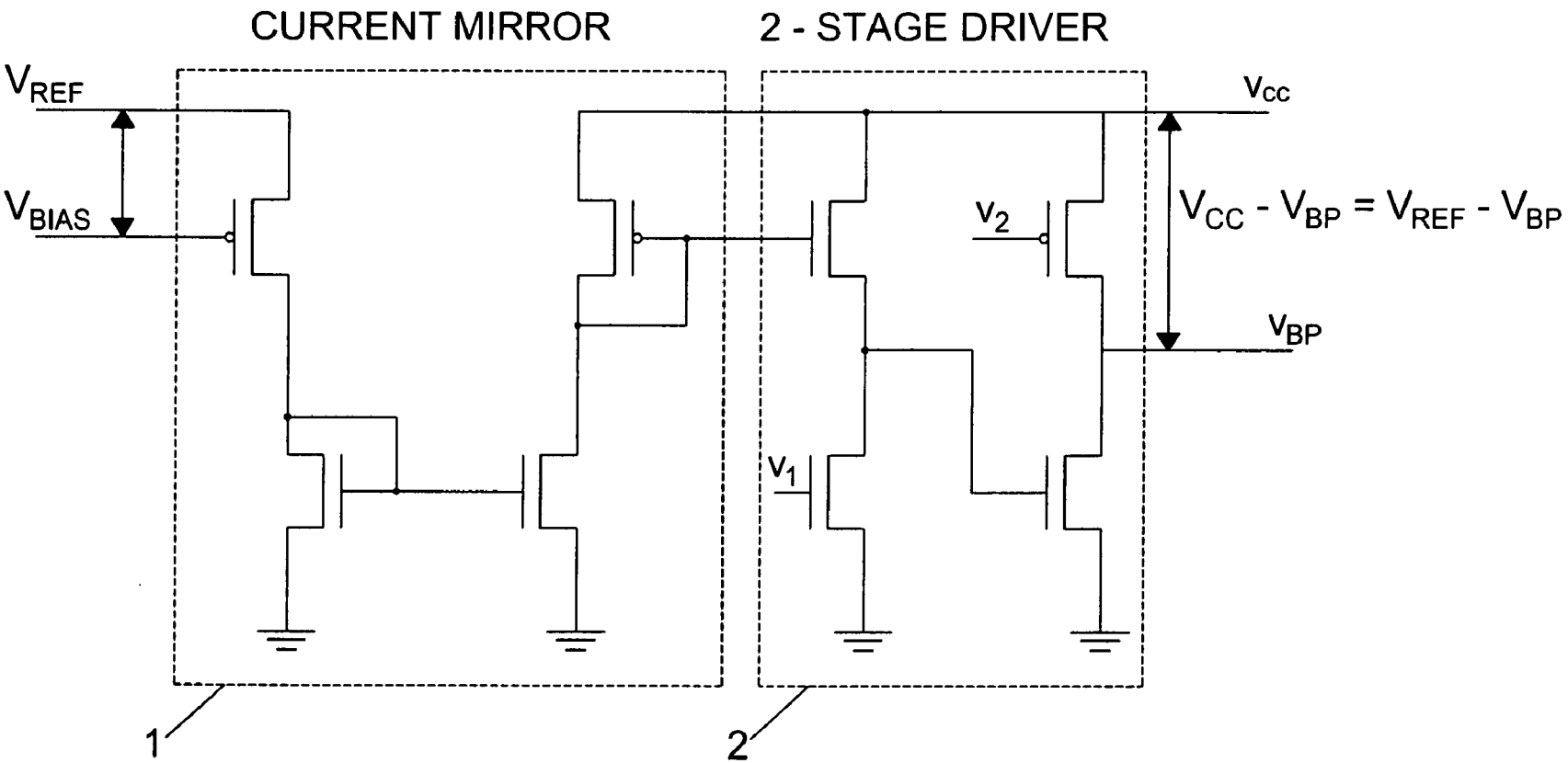
FIG. 1 shows a local bias generator according to an example arrangement.

In the following detailed description, like reference numerals and characters may be used to designate identical, corresponding or similar components in differing figure drawings. Further, in the detailed description to follow, example sizes/models/values/ranges may be given although the present invention is not limited to the same. Well-known power/ground connections to integrated circuits (ICs) and other components may not be shown within the FIGS. for simplicity of illustration and discussion. Further, arrangements and embodiments may be shown in block diagram form in order to avoid obscuring the invention, and also in view of the fact that specifics with respect to implementation of such block diagram arrangements may be dependent upon the platform within which the present invention is to be implemented. That is, the specifics may be within the purview of one skilled in the art. Where specific details are set forth in order to describe example embodiments of the invention, it should be apparent to one skilled in the art that the invention can be practiced without these specific details.

Further, while values or signals may be described as HIGH ("1") or LOW ("0"), these descriptions of HIGH and LOW are intended to be relative to the discussed arrangement and/or embodiment. That is, a value or signal may be described as HIGH in one arrangement although it may be LOW if provided in another arrangement, such as with a change in logic. The terms HIGH and LOW may be used in an intended generic sense. Embodiments and arrangements may be implemented with a total/partial reversal of the HIGH and LOW signals by a change in logic.

Embodiments of the present invention may relate to a bias generator that includes a central bias generator and a local bias generator. The central bias generator may include a replica bias generator circuit corresponding to the local bias generator. The local bias generator may include a single-stage source-follower circuit to generate a forward body bias for a functional block or other device. The single-stage source-follower circuit may include matched NMOS transistors to convert an output voltage of the central bias generator into a forward body bias for the local bias generator and eventually the functional block or other device.

The type and complexity of a local bias generator may depend on whether forward body bias, reverse body bias, or both will be applied. FIG. 1 shows a local bias generator according to an example arrangement. Other arrangements are also possible. If only forward bias is applied, then the local body bias generator shown in FIG. 1 may be used, for example. More specifically, FIG. 1 shows a LBG that may include two stages. The first stage may include a current mirror 1 that translates a voltage $V_{BIAS}$ from a CBG (not shown) referenced to a voltage $V_{REF}$ (also from a CBG) into a voltage which is referenced to the supply voltage $V_{CC}$ of a corresponding local block (not shown). The second stage may be a two-stage source-follower circuit (or stage driver) 2 that provides drive strength to supply body bias voltage $V_{BP}$ to the local block. The circuit may operate so that the output differential voltage ($V_{CC}-V_{BP}$) always equals (or substantially equals) the input differential Voltage ($V_{REF}-V_{BIAS}$).

However, the circuit shown in FIG. 1 may lose tracking as an input differential becomes small. This may occur because the transistors in the current mirror 1 as well as the output stage fall out of saturation as the desired bias becomes smaller. Additionally, the multiple-circuit stages used to implement the local bias generator may consume larger chip area and cause the generator to consume considerable static power.

Another type of bias generator may include an operational amplifier structure in a feedback configuration. This circuit may operate from a higher supply voltage than the local block $V_{CC}$ and may be able to apply any bias value from forward body bias to reverse body bias. Tracking with the local $V_{CC}$ may be automatically performed through the feedback structure. While this circuit does not have all the drawbacks of the design shown in FIG. 1, its implementation may consume an even larger chip area and require an even higher supply voltage for the amplifier. This design may therefore be considered suitable when both forward and reverse body bias needs to be applied.

Figure 2:
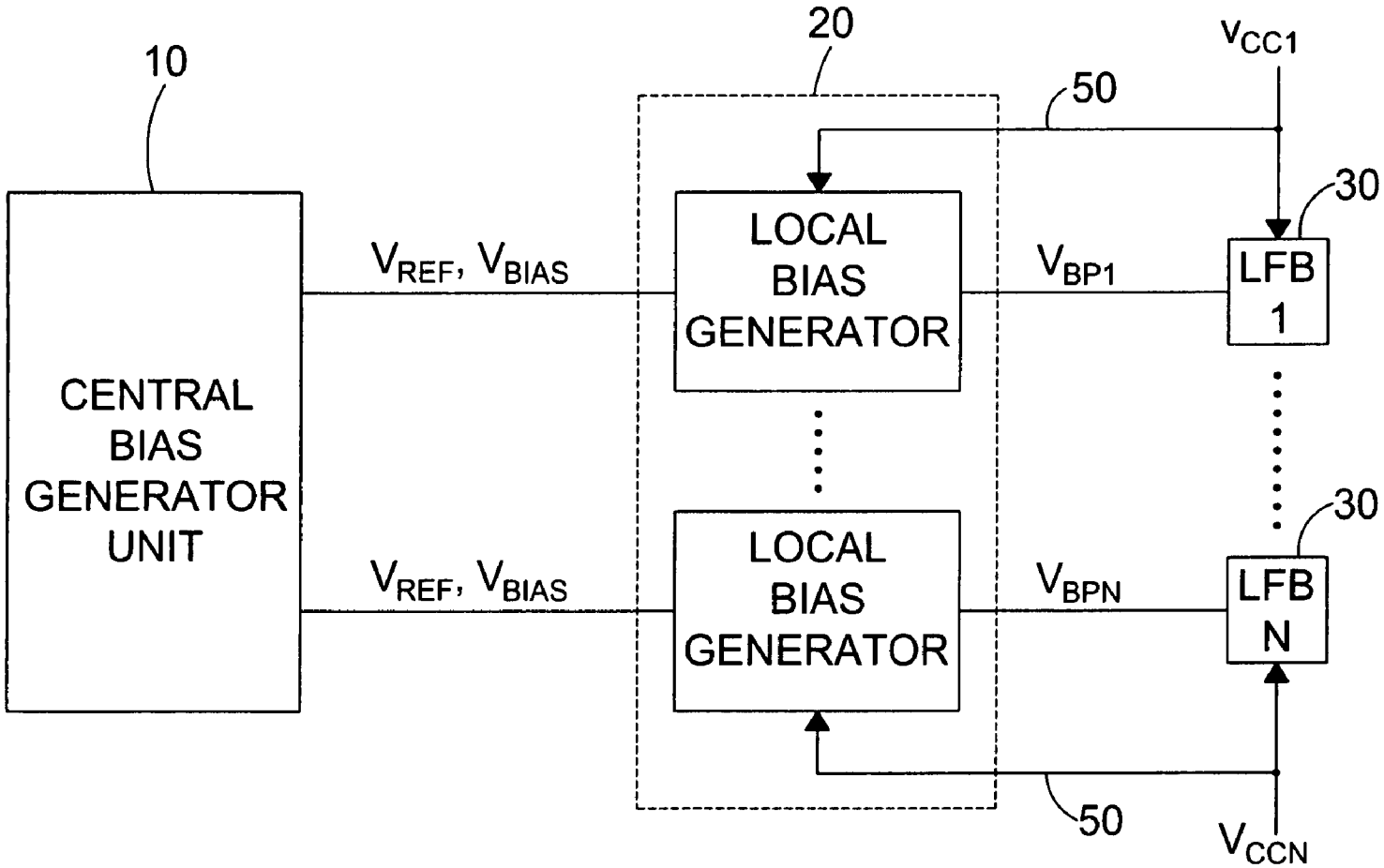
FIG. 2 shows a bias generator according to an example arrangement.

FIG. 2 shows a bias generator according to an example arrangement. Other arrangements are also possible. More specifically, the bias generator may include a central bias generator unit 10 and a local bias generator unit 20. The local bias generator unit 20 may be coupled to one or more circuits 30 located on or off the same chip (or die) on which the generator units are located. These circuits, generally referred to as local functional blocks (LFBs), may include one or more transistors that operate as switches or amplifiers or perform any other function. The local functional blocks may be coupled to one another such that the output of one block serves as the input into one or more other blocks, the blocks may be separately situated to generate signals for performing independent tasks, or a combination of the two is possible.

The central bias generator unit 10 may generate reference and bias voltages ($V_{REF}$, $V_{BIAS}$) that are used in deriving local biasing voltages for each of the functional blocks. These voltages may be generated in a manner that is process, voltage, and temperature independent.

The central bias generator unit 10 may be configured to generate one or more reference and body bias voltages based on the requirements of the intended application of the chip or host system and the type of transistor technology used in the local functional blocks. If both PMOS and NMOS transistors are included in the local functional blocks, then the central bias generator unit 10 may include two central bias generators each generating a separate reference voltage for the PMOS and NMOS transistors. Alternatively, one central bias generator capable of generating separate reference voltages for the transistor types may be used. In terms of relative placement, the central bias generator unit 10 may be located on the same chip as the local bias generators or the CBG may be located off-chip.

Figure 3:
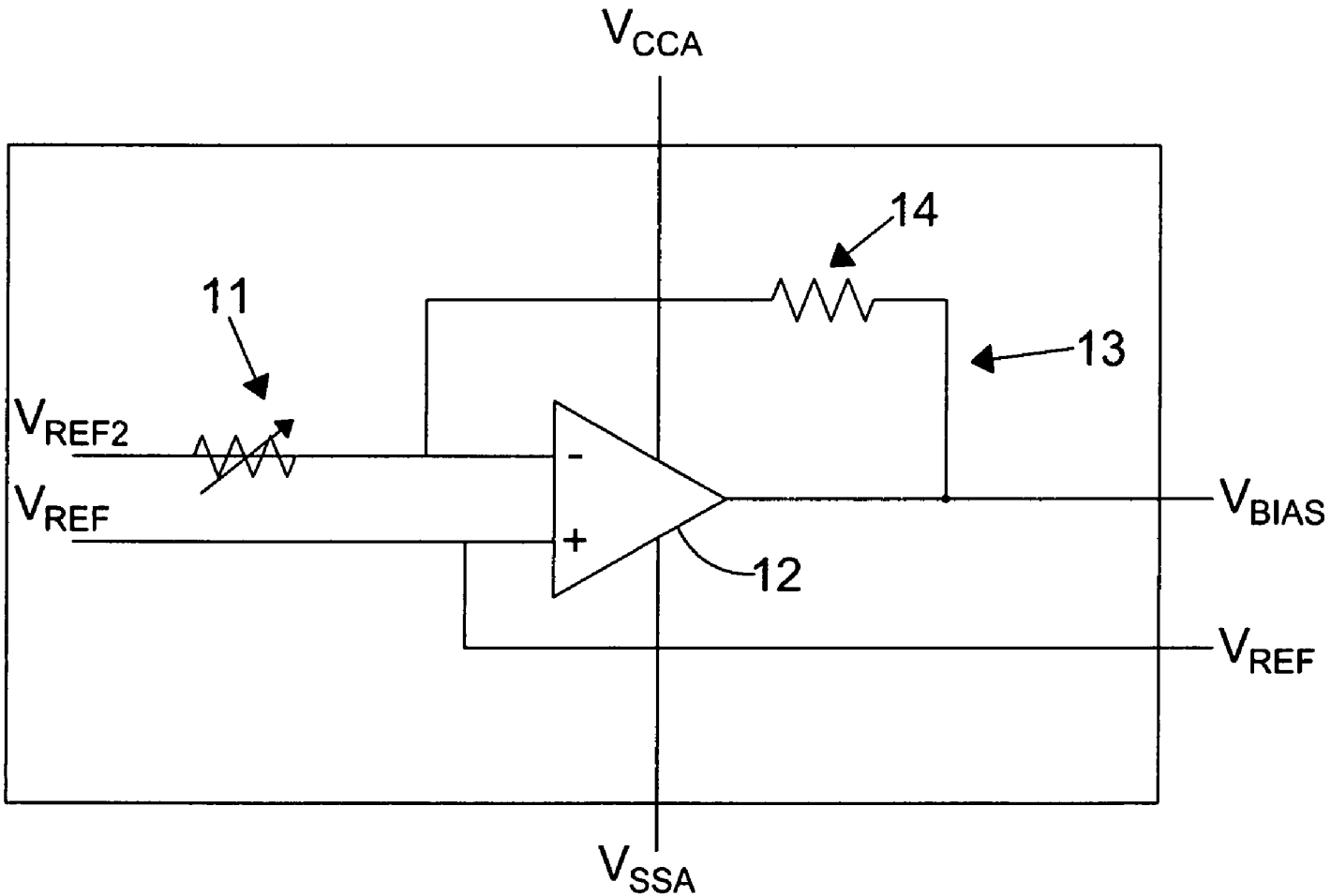
FIG. 3 shows a central bias generator according to an example arrangement.

FIG. 3 shows a central bias generator according to an example arrangement. Other arrangements are also possible. This central bias generator may include a variable resistor 11, an operational amplifier 12, and a feedback path 13 that includes a resistor 14. The variable resistor 11 may, for example, be formed from an R-2R resistor network coupled to input a variable reference voltage $V_{REF2}$ into an inverting terminal of the amplifier 12. A fixed reference voltage $V_{REF}$ may be input into a non-inverting terminal. The amplifier 12 may be driven by supply voltages $V_{CCA}$ and $V_{SSA}$. The feedback path 13 may include the resistor 14 that determines the output bias voltage in combination with the variable resistor 11 in accordance with the following equation: $V_{BIAS}=V_{REF2}-(R_{FBK}/R_{VAR})(V_{REF2}-V_{REF})$, where $R_{FBK}/R_{VAR}$ is a ratio of the feedback and variable resistances.

In operation, the output of the variable resistor 11 may set the bias voltage $V_{BIAS}$ generated by the CBG unit. As this resistance changes, the bias voltage changes relative to the fixed reference voltage. The bias and reference voltages are then output to the local bias generators such as shown in FIG. 2, for example. One skilled in the art can appreciate that this circuit shows one possible configuration of a central bias generator that may be included in the unit 10, and that other types of CBGs may also be used.

The local bias generator unit 20 may include one or more local bias generators, each of which may include a single-stage circuit that operates to ensure that a constant bias voltage (e.g., $V_{BP1}$ or $V_{BPN}$ as shown in FIG. 2) is supplied to a respective one of the local functional blocks (LFBs).

Figure 4:
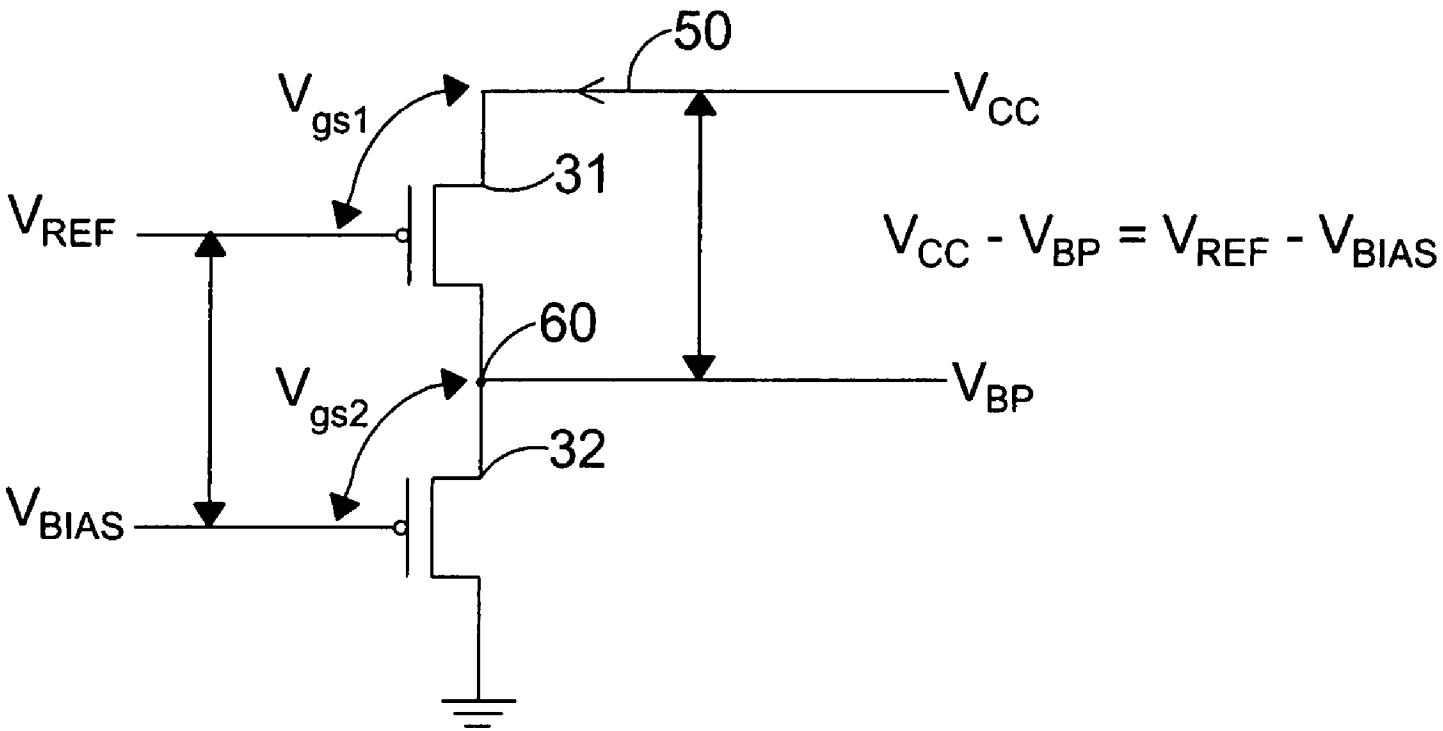
FIG. 4 shows a local bias generator according to an example arrangement.

FIG. 4 shows a local bias generator according to an example arrangement. Other arrangements are also possible. More specifically, the local bias generator may include an amplifier that preferably has unity gain and generates an output signal that "follows" its input signal. In the example arrangement shown, the amplifier is in the form of a single-stage source-follower (buffer) circuit. This circuit may include two field-effect (FET) transistors 31 and 32. The drain of the transistor 31 is coupled to the source of transistor 32, the drain of the transistor 32 is coupled to a reference potential, and the gates of the transistors 31, 32 respectively receive the reference and bias voltages $V_{REF}$ and $V_{BIAS}$ output from the central bias generator unit. The reference potential may be ground or some other value.

As shown in FIG. 2, each local functional block may be powered by a respective supply voltage $V_{CC1}$ through $V_{CCN}$, where N equals the number of functional blocks. These supply voltages may be input into corresponding ones of the local bias generators along a signal line(s) 50, which is coupled to the source of the transistor 31. As shown in FIG. 4, a node 60 may output a bias voltage $V_{BP}$. The single-stage source-follower circuit may provide adaptive body bias by constantly adjusting the bias voltage $V_{BP}$ to track variations in parameters.

However, applying body bias to NMOS transistors in a standard (non-triple-well or dual-well) process may involve additional complexities. That is, because all the NMOS transistors share a common substrate (such as a p-substrate), all transistors on the microprocessor die may receive the same body bias. Therefore, even the bias generator circuits are themselves body-biased, the body bias may change the threshold $V_t$ of the devices and thus matching of stacked devices may not be possible.

Figure 5:
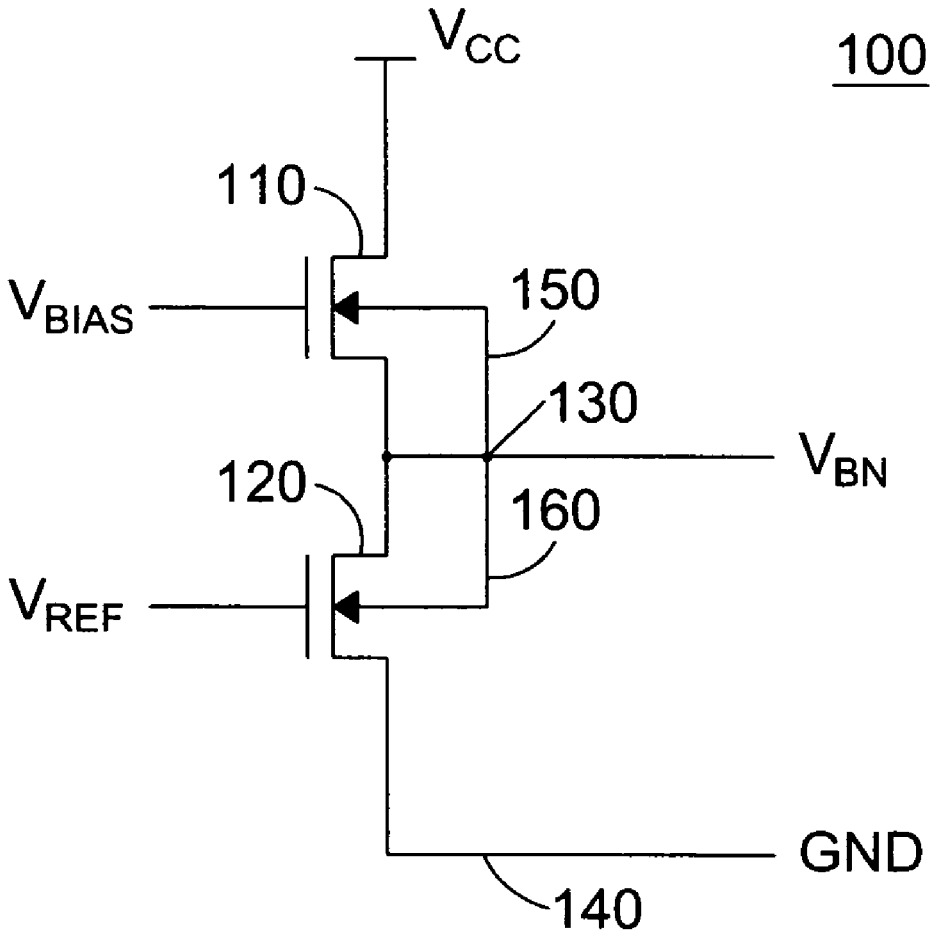
FIG. 5 shows a local bias generator according to an example arrangement.

FIG.5 shows a local bias generator in accordance with an example arrangement. Other arrangements are also possible. The LBG 100 may be implemented as a single source-follower stage that includes two NMOS transistors 110 and 120, where the source of the transistor 110 is connected to a drain of the transistor 120 and the gates of these transistors respectively receive the bias and reference voltages $V_{BIAS}$ and $V_{REF}$ output from the central bias generator. A drain of the transistor 110 is coupled to a supply potential $V_{CC}$ and a source of the transistor 120 is coupled to a reference potential which, for example, may be ground. A node 130 between the transistors outputs the forward body bias voltage $V_{BN}$ and a signal line 140 coupled to the drain of the transistor 120 provides the reference potential (shown as GND) to one or more local functional blocks.

The NMOS transistors may be arranged to have a dual-well configuration (evident from arrows 150 and 160) in which both transistors share the same substrate. In this configuration, the transistor body may not be locally tied to the source. As a result, for the NMOS bias implementation of FIG. 5, the top transistor 110 may have zero body bias while the bottom transistor 120 may receive a varying forward bias as the output voltage changes.

Figure 6:
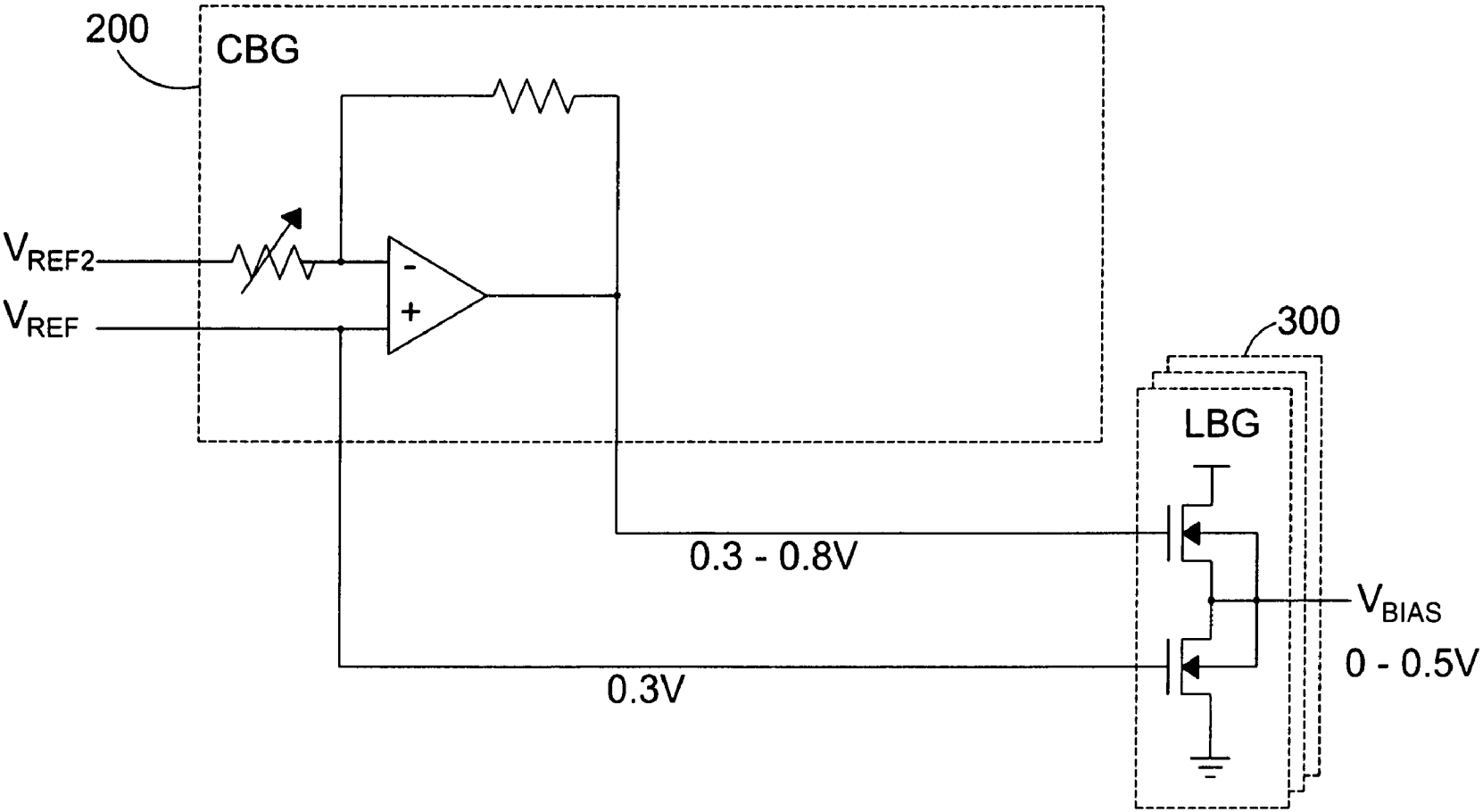
FIG. 6 shows an NMOS adaptive body bias generator having a central bias generator and a source-follower local bias generator circuit according to an example arrangement.

FIG. 6 shows an NMOS adaptive body bias generator using a central bias generator 200 and a source-follower local bias generator circuit 300 according to an example arrangement. Other arrangements and voltages are also possible. While the following description of FIG. 6 will be with respect to one local bias generator circuit, other local bias generator circuits may also be provided about the die (or off the die).

In this example arrangement, the CBG 200 (and the LBG 300) only applies a forward body bias to the NMOS transistors on the die. The CBG 200 may output a varying reference voltage from 0.3 V to 0.8 V, for example, depending on the desired FBB. The local bias generator 300 may translate this input voltage to an output ($V_{BIAS}$) that ideally ranges from 0.0V to 0.5V, for example. The LBG 300 shown in FIG. 6 is an NMOS version of a bias generator. The two LGB NMOS transistors within the LGB 300 may be matched so that both devices have equal Vgs voltages and thus the output voltage tracks the input voltage with a constant drop of Vgs (0.3 V in this example). As the output voltage rises, however, the bottom transistor may become forward biased while the top transistor remains zero-biased. As a result, the Vgs of the bottom transistor may be smaller for a same current and thereby the range of the LBG 300 may be reduced. Therefore, when the input voltage is maximum (0.8V), the LBG 300 may not output 0.5 V, but rather may output a smaller value such as 0.43V, for example.

Figure 7:
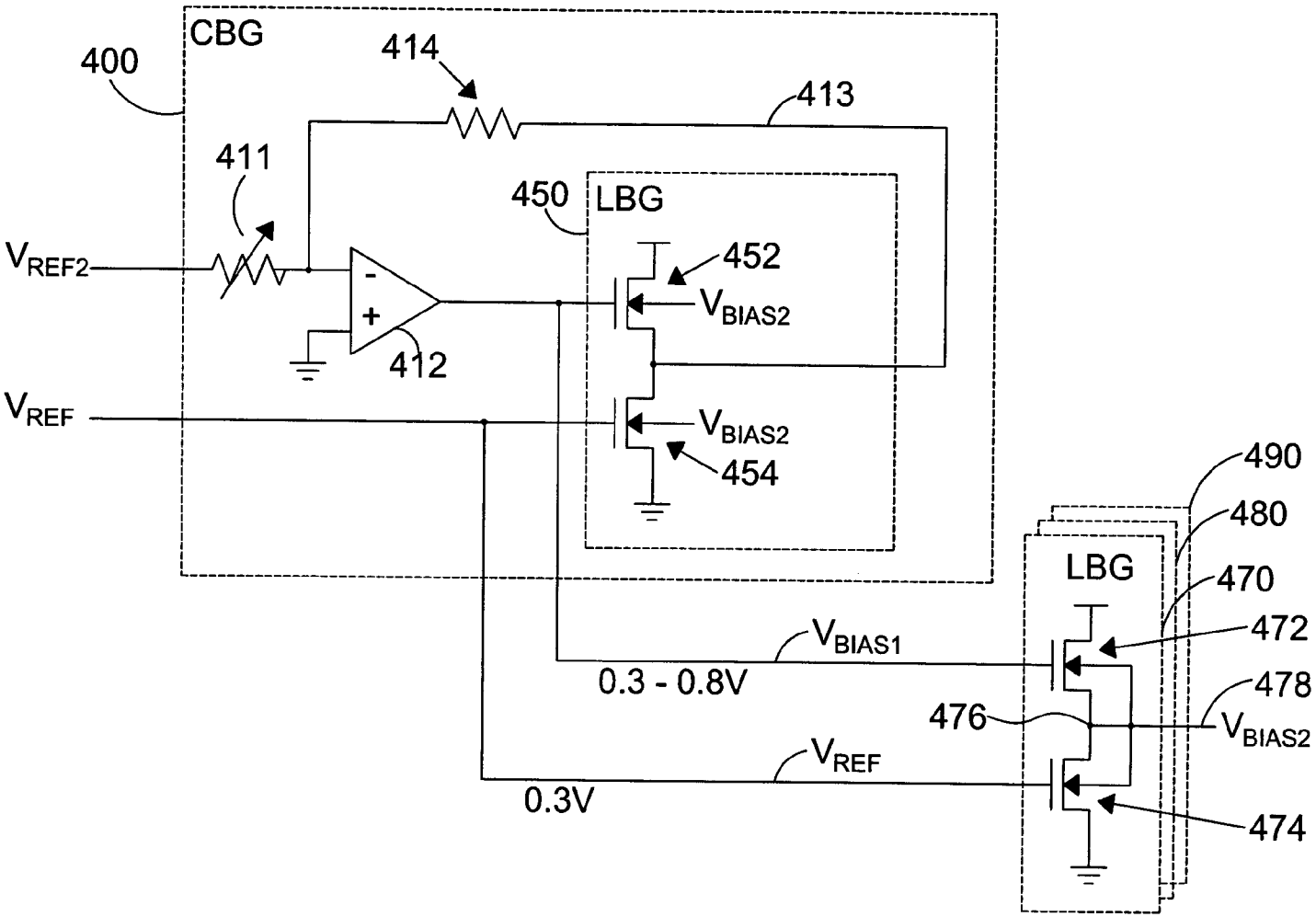
FIG. 7 shows an NMOS adaptive body bias generator having a central bias generator and a source-follower local bias generator circuit according to an example embodiment of the present invention.

FIG. 7 shows an NMOS adaptive body bias generator using a central bias generator 400 and a source-follower local bias generator circuit 470 according to an example embodiment of the present invention. Other embodiments and configurations are also within the scope of the present invention. While the following description of FIG. 7 will be with respect to one local bias generator circuit, other local bias generator circuits may also be provided about the die (or off the die). FIG. 7 shows two other local bias generator circuits 480 and 490.

More specifically, FIG. 7 shows that the central bias generator 400 may include a variable resistor 411, an operational amplifier 412 and a feedback path 413 that includes a resister 414. The variable resister 411 may, for example, be formed from an R-2R resistor network coupled to input a variable reference voltage $V_{REF2}$ into an inverting terminal of the amplifier 414. The non-inverting terminal of the amplifier 412 may be connected to the ground supply which is at the same potential as the ground of the local bias generator. The variable and fixed reference voltages may be set based on a desired range of the bias voltage. The amplifier 412 may be driven by supply voltages (not shown in FIG. 7) such as $V_{CCA}$ and $V_{SSA}$.

The LBG 470 may be implemented as a single source-follower stage that includes two NMOS transistors 472 and 474, where the source of the transistor 472 is connected to a drain of the transistor 474 and the gates of these transistors respectively receive the bias voltage $V_{BIAS1}$ and the reference voltage $V_{REF}$ output from the central bias generator 400. In this example, the bias voltage may vary. A drain of the transistor 472 is coupled to a supply potential $V_{CC}$ and a source of the transistor 474 is coupled to a reference potential which, for example, may be ground. A node 476 between the transistors 472, 474 outputs a forward body bias voltage $V_{BIAS2}$ along a signal line 478. This bias voltage may be output to devices within the function block(s) either on the die or off the die.

Embodiments of the present invention may automatically compensate for mismatch in the LBG transistors 472, 474 by including a replica circuit 450 (or replica LBG) of the LBG 470 in the feedback path (or loop) 413 of the CBG 400. Stated differently, the replica LBG 450 may compensate for body effect of the LBG transistors 472, 474. This replica LBG 450 may be an exact copy (or substantially exact copy) of the LBG 470 that is distributed throughout the die so that the transistor characteristics are identical (in the absence of within-die process variation).

Accordingly, the input voltage to the replica LBG 450 may be automatically set to a correct value that gives the desired bias voltage at the output. This voltage may then be routed to all LBGs as the reference voltage input.

More specifically, the replica LBG 450 may include a single source-follower stage that includes two NMOS transistors 452 and 454, where the source of the transistor 452 is connected to a drain of the transistor 454 and the gate of the transistor 452 receives the output of the amplifier 412 while the gate of the transistor receives the reference voltages $V_{REF}$. A drain of the transistor 452 is coupled to a supply potential $V_{CC}$ and a source of the transistor 454 is coupled to a reference potential which, for example, may be ground. A node between the transistors is coupled to the feedback path 413. In this embodiment, the forward body bias voltage $V_{BIAS2}$ output along the signal line 478 from the LBG 470 may be input to the bodies of each of the transistors 452 and 454 of the replica circuit 450.

As one example, the CBG 400 may now output a varying reference voltage from 0.3 V to 0.8 V and the LGB 470 may according apply a bias voltage of 0 V to 0.5 V. That is, embodiments of the present invention may automatically adjust an output of the CBG so that a bias output of the LBG is better. The replica LBG automatically adjusts to compensate for problems of disadvantageous arrangements.

Embodiments of the present invention may thereby adjust the output of the CBG 400 based on an expected mismatch in the transistors of the LBG 470. In this way, an operating range at the output of the LBG 470 may be improved. This may improve the overall effectiveness of the adaptive body bias scheme.

Embodiments of the present invention may increase the output voltage of the CBG to compensate for the range loss due to body effect. For example, the maximum CBG output may be set to 0.9 V rather than 0.8 V in order to allow the LBG output to reach a maximum FBB of 0.5 V.

Embodiments of the present invention may improve tracking at an upper end of the bias range (i.e., FBB near 0.5 V). Embodiments of the present invention may also improve tracking at the lower end (i.e., near 0 V FBB). At the low end of the range, the transistors in the LBG 470 are no longer in saturation and the tracking becomes poor. Because the replica LBG 450 exhibits the same tracking behavior, the low end tracking may be improved.

One output voltage range may be from 20 mV to 500 mV FBB as compared with 40 mV to 450 mV FBB for arrangements, such as shown in FIG. 5. This shows that the tracking has been approved at both ends of the range. By including the replica LBG 450 in the CBG feedback loop 413, improved tracking may be obtained without having to resort to a complex and area-inefficient LBG structure.

While embodiments of the present invention have been described with respect to an NMOS adaptive body bias generator having NMOS transistors, embodiments of the present invention may also include a PMOS adaptive body bias generator having PMOS transistors such as within the source follower LBG and the replica circuit (or the replica LBG).

Figure 8:
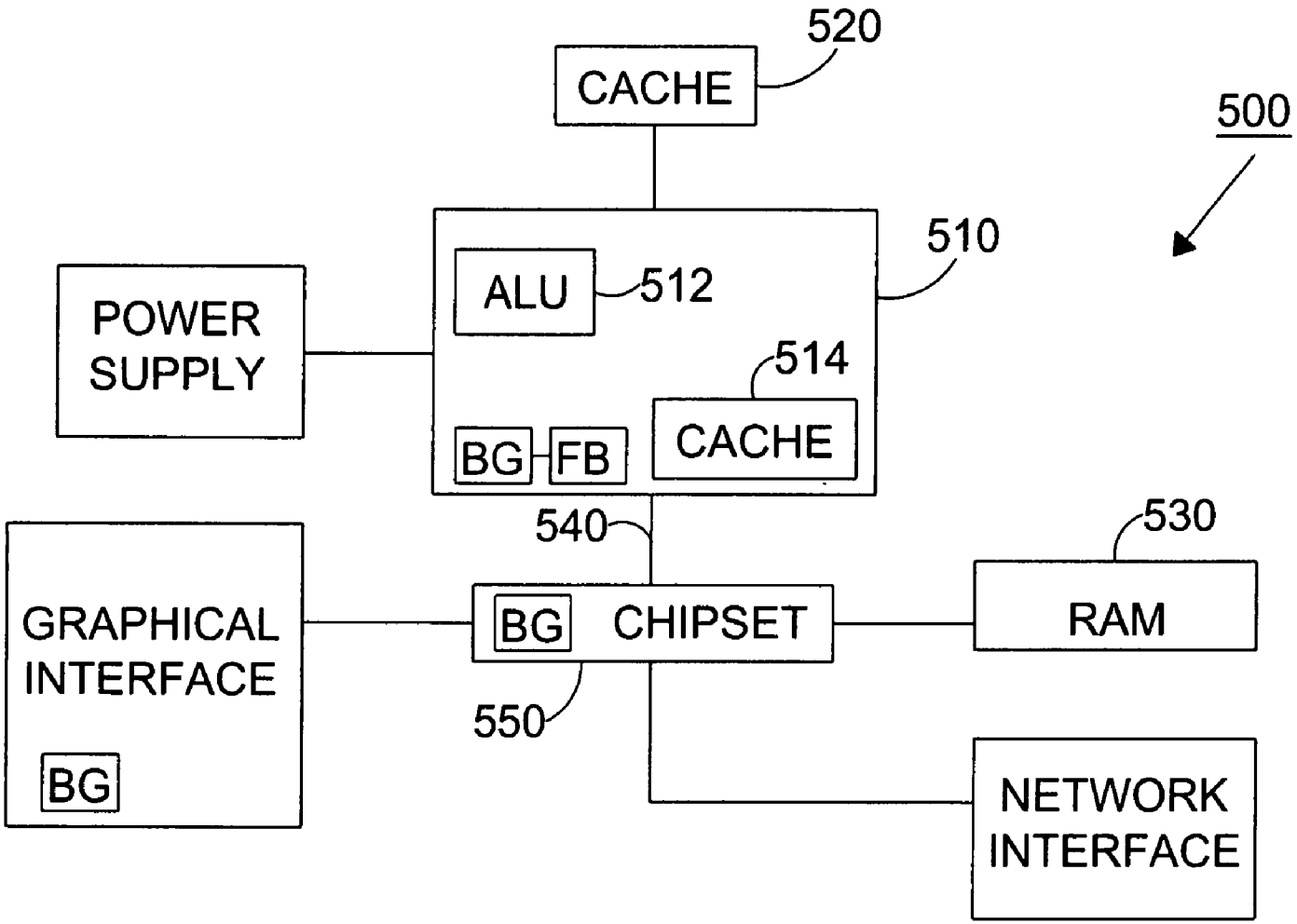
FIG. 8 is a block diagram of a system according to an example embodiment of the present invention.

FIG. 8 is a block diagram of a system (such as a computer system 500) according to an example embodiment of the present invention. Other embodiments and configurations are also within the scope of the present invention. More specifically, the computer system 500 may include a processor 510 that may have many sub-blocks such as an arithmetic logic unit (ALU) 512 and an on-die (or internal) cache 514. The processor 510 may also communicate to other levels of cache, such as off-die cache 520. Higher memory hierarchy levels such as a system memory (or RAM) 530 may be accessed via a host bus 540 and a chip set 550. The system memory 530 may also be accessed in other ways, such as directly from the processor 510 and/or without passing through the host bus 540 and/or the chip set 550. In addition, other off-die functional units such as a graphics accelerator and a network interface controller, to name just a few, may communicate with the processor 510 via appropriate busses or ports. The system 500 may also include a wireless interface to interface the system 500 with other systems, networks, and/or devices via a wireless connection.

A bias generation (shown as BG) including a central bias generator and/or a local bias generator may be included in various components of the system 500, such as the processor 510, the graphical interface and the chipset 550, in order to provide forward body bias in accordance with an example embodiment of the present invention. For example, the bias generator may be used to control an operating frequency of the processor and/or may be used to control a reference signal supplied to any of the internal circuits (e.g., functional block FB) of the processor or any circuit coupled thereto.

In the foregoing description, the term "central" is used in connection with the central bias generator only in the sense that an output of the CGB may be distributed to provide forward or reverse body bias, or both, via one or more of the local bias generators, to a number of transistors in the local functional block(s).

In the foregoing description, the local bias generator provides forward bias to one or more local functional blocks. The local functional blocks may include groups of circuitry (on one or more IC dies) designed to impart a certain logic or mixed signal (analog/digital) functionality to the electrical system embodied within or including generator units. The blocks may be manufactured, for example, using an entirely MOS process in which all of the active devices are FETs, a Bipolar-MOS process in which other transistors in addition to FETs are provided. The MOS process may involve the use of only PMOS or NMOS transistors, or a CMOS process may be implemented in which both transistor types are used. In general, there is some flexibility in the physical placement of the CBG, LBGs, and FUBs. In most advanced CMOS ICs, however, all three components are most likely to be formed on the same IC die for lower cost and better performance.

The functional unit blocks may, for example, include any one or more of the following types of circuits: adders, multipliers, register files, cache memory blocks, control logic, analog blocks such as phase-locked loops, clock generators, and sense amplifiers to name a few, as well as any other type of circuit that may be included in a local functional block on a circuit die.

Systems represented by the various foregoing figures can be of any type. Examples of represented systems include computers (e.g., desktops, laptops, handhelds, servers, tablets, web appliances, routers, etc.), wireless communications devices (e.g., cellular phones, cordless phones, pagers, personal digital assistants, etc.), computer-related peripherals (e.g., printers, scanners, monitors, etc.), entertainment devices (e.g., televisions, radios, stereos, tape and compact disc players, video cassette recorders, camcorders, digital cameras, MP3 (Motion Picture Experts Group, Audio Layer 3) players, video games, watches, etc.), and the like.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments of the present invention have been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A bias generator comprising:

a central bias generator to provide a first bias voltage; and a local bias generator to receive the first bias voltage and to provide a second bias voltage, the central bias generator including a replica bias generator circuit corresponding to the local bias generator, the replica bias generator circuit to receive the second bias voltage from the local bias generator.

2. The bias generator of claim 1, wherein the local bias generator includes a single-stage source-follower circuit to generate a forward body bias for a functional block, the forward body bias being provided based on the second bias voltage from the local bias generator.

3. The bias generator of claim 2, wherein the single-stage source-follower circuit includes first and second matched transistors to convert the first bias voltage into the second bias voltage.

4. The bias generator of claim 3, wherein the single-stage source-follower circuit further includes a node coupled between the first and second matched transistors, the node providing the second bias voltage as the forward body bias to the functional block.

5. The bias generator of claim 3, wherein the first and second matched transistors comprise n-channel metal-oxide semiconductor (NMOS) transistors.

6. The bias generator of claim 5, wherein the NMOS transistors are provided in a non-triple well structure.

7. The bias generator of claim 1, wherein the central bias generator includes:

an amplifier having at least an input and an output; and a feedback loop coupled between the output and the input of the amplifier.

8. The bias generator of claim 7, wherein the replica bias generator circuit is provided within the feedback loop of the central bias generator.

9. The bias generator of claim 8, wherein the replica bias generator circuit comprises first and second n-channel metal-oxide semiconductor (NMOS) transistors.

10. A die comprising:

a functional block unit;

a first bias generator including an amplifier, a single-stage source-follower circuit and a feedback loop, the first bias generator to provide a first bias signal; and a second bias generator to receive the first bias signal and to provide a second bias signal to the functional block unit, the single-stage source-follower circuit being provided within the feedback loop, and the single-stage source-follower circuit to receive the second bias signal.

11. The die of claim 10, wherein the single-stage source-follower circuit comprises a replica circuit of the second bias generator.

12. The die of claim 11, wherein the second bias generator includes first and second matched transistors to convert a bias voltage output from the first bias generator into the bias signal.

13. The die of claim 12, wherein the second bias generator includes a node coupled between the first and second matched transistors, the second bias signal being provided at the node as a forward body bias to the functional block unit.

14. The die of claim 12, wherein the first and second matched transistors comprise n-channel metal-oxide semiconductor (NMOS) transistors.

15. The die of claim 14, wherein the NMOS transistors are provided in a non-triple well structure.

16. The die of claim 10, wherein the single-stage source-follower circuit comprises first and second n-channel metal-oxide semiconductor (NMOS) transistors.

17. An electronic system comprising:

a die;

a power supply to supply power to the die; and a body bias circuit, on the die to provide a body bias voltage, the body bias circuit including:

a central bias generator to provide a first voltage; and a local bias generator to receive the first voltage and to provide the body bias voltage, the central bias generator including a replica bias generator circuit to receive the body bias voltage from the local bias generator.

18. The electronic system of claim 17, wherein the local bias generator is provided on the die.

19. The electronic system of claim 17, wherein the central bias generator is provided on the die.

20. The electronic system of claim 17, wherein the central bias generator includes:

an amplifier having at least an input and an output; and a feedback loop coupled between the output and the input of the amplifier.

21. The electronic system of claim 20, wherein the replica bias generator circuit is provided within the feedback loop of the central bias generator.

22. The electronic system of claim 17, wherein the replica bias generator circuit comprises first and second n-channel metal-oxide semiconductor (NMOS) transistors.

* * * * *